US012129615B2

(12) United States Patent
Winter

(10) Patent No.: US 12,129,615 B2
(45) Date of Patent: Oct. 29, 2024

(54) PLOW GUARD

(71) Applicant: Winter Equipment Company, Willoughby, OH (US)

(72) Inventor: Kent Winter, Willoughby, OH (US)

(73) Assignee: Winter Equipment Company, Willoughby, OH (US)

( * ) Notice: Subject to any disclaimer, the term of this patent is extended or adjusted under 35 U.S.C. 154(b) by 346 days.

(21) Appl. No.: 17/236,809

(22) Filed: Apr. 21, 2021

(65) Prior Publication Data

US 2022/0341111 A1 Oct. 27, 2022

(51) Int. Cl.
*E01H 5/06* (2006.01)

(52) U.S. Cl.
CPC ..... *E01H 5/066* (2013.01); *E01H 5/06* (2013.01); *E01H 5/061* (2013.01)

(58) Field of Classification Search
CPC .... E01H 5/00; E01H 5/04; E01H 5/06; E01H 5/061; E01H 5/062; E01H 5/063; E01H 5/065; E01H 5/066; E01H 5/067; E01H 5/068
USPC ..... 37/270
See application file for complete search history.

(56) References Cited

U.S. PATENT DOCUMENTS

| | | | | |
|---|---|---|---|---|
| 4,346,528 | A * | 8/1982 | Shwayder | E02F 9/285 37/270 |
| 4,833,801 | A * | 5/1989 | Winter | E01H 5/066 172/701.2 |
| 5,636,458 | A * | 6/1997 | Drake | E01H 5/066 37/270 |
| 7,874,085 | B1 * | 1/2011 | Winter | E01H 5/061 37/270 |
| D839,926 | S * | 2/2019 | Winter | D15/28 |
| 2016/0069032 | A1 * | 3/2016 | Winter | E01H 5/066 37/270 |
| 2018/0100279 | A1 * | 4/2018 | Aquino | E01H 5/061 |

FOREIGN PATENT DOCUMENTS

| | | | | |
|---|---|---|---|---|
| SE | 458373 B | * | 3/1989 | E01H 5/065 |

* cited by examiner

*Primary Examiner* — Jamie L McGowan
*Assistant Examiner* — Audrey L Lusk
(74) *Attorney, Agent, or Firm* — Tucker Ellis LLP

(57) ABSTRACT

A steel serrated plow guard with combination carbide insert which can be mounted on most plow blades is provided. The plow guard can be mounted onto most plow blades through the universal mounting elongated slot. The exemplary plow guard for mounting to a snowplow includes a plow guard body, a plow guard wear surface along the plow guard body, at least one enlarged outer edge on the plow guard body, at least one serrated cutting surface attached to the plow guard wear surface, an elongated horizontal slotted punch aperture along the plow guard body, and at least one longitudinal carbide matrix groove.

10 Claims, 7 Drawing Sheets

PLOW GUARD

BACKGROUND

The present exemplary embodiment relates to plow edge protection. It finds particular application in conjunction with an apparatus and method for improving the durability, performance, and operation of plow and grader blades and will be described with particular reference thereto. However, it is to be appreciated that the present exemplary embodiment is also amenable to other like applications.

Rough terrain and cold weather conditions have caused problems for plow blades for as long as there have been plows. Although many modifications and alternative designs have been made to plow blades in attempts to improve the life, durability, and performance of plow blades, and in particular the life, durability, and performance of plow blade edges, most of these modifications and alterations did not provide sufficient durability and ride improving capabilities to deal with, among other things, the rough terrain and cold weather that plow blades are typically exposed to. Typically, prior art plow edges are metallic (for example, steel), and they are excessively damaged or even destroyed due to wear from contact between the plow edge and the terrain and corrosion, which may be exacerbated by road salt. Such prior art blade edges must frequently be repaired or replaced.

Additionally, it is conventional to provide to the plow or plow attachment frame caster-like wheels, mushroom shoes, or wear skid shoes which are attached to, but spaced from, the plow moldboard for the purpose of supporting part of the load on the blade. These known prior art devices are relatively bulky, expensive to manufacture, and difficult to install on the plow. The cast iron material typically used on the wear shoes does not provide protection against fracturing or break-age, due to the relative brittleness of cast iron when the shoes are subjected to impacts. Further these shoes do not protect the side edges of the plow from contact with curbs. The shoes are expensive to maintain and replace.

Thus, there has been a need for an improved means of protecting the cutting edge of, for example, a plow blade from the roadbed and curbside and reducing the undesirable abrasive action on the blade edge. The disadvantages of present plow blade edge protection have resulted in the improved plow guard and mountings of the exemplary embodiment which effectively reduces blade wear resulting from road abrasion. Furthermore, the exemplary embodiment can increase blade (cutting edge) life, reduce blade breakage and maintenance, while also providing a simple means of replacement.

BRIEF DESCRIPTION

In one embodiment a steel serrated plow guard with combination carbide insert which can be mounted on most plow blades is provided. The plow guard can be mounted onto most plow blades through the universal mounting elongated slot. The exemplary plow guard for mounting to a snowplow includes a plow guard body, a plow guard wear surface along the plow guard body, at least one enlarged outer edge on the plow guard body, at least one serrated cutting surface attached to the plow guard wear surface, an elongated horizontal slotted punch aperture along the plow guard body, and at least one longitudinal carbide matrix groove.

Optionally, the serrated cutting surface may comprise at least one protruding tooth, wherein the protruding tooth comprises a plurality of peaks and channels. The serrated cutting surface may be raised normal to the plow guard wear surface by at least a sixteenth of an inch. The serrated cutting surface may be comprised of a plurality of protruding teeth each separated from one another long the plow guard wear surface.

The horizontal slotted punch aperture may align with a plurality of mounting holes of a plow blade and the mounting holes of a mold board.

The plurality of fasteners can be inserted through the elongated horizontal slotted punch apertures to engage the mounting holes of the plow blade and the mounting holes of the mold board.

The longitudinal carbide matrix groove may be located along the bottom face of the plow guard body.

Optionally, a carbide matrix is deposited into said longitudinal carbide matrix groove. The carbide matrix may be deposited into said longitudinal carbide matrix groove by a weld wire.

The plow guard may be a single piece cast steel.

In a further embodiment a plow guard for mounting to a snowplow is provided. The plow guard includes a plow guard body, a plow guard wear surface along the plow guard body; an enlarged outer edge on the plow guard body, a serrated cutting surface attached to the plow guard wear surface wherein said serrated cutting surface comprises a plurality of protruding teeth, wherein the protruding teeth comprise a plurality of peaks and channels, two elongated horizontal slotted punch apertures along the plow guard body wherein said horizontal slotted punch apertures are not connected to one another and are on different halves of the plow guard body, wherein the horizontal slotted punch apertures aligns with a plurality of mounting holes of a plow blade and the mounting holes of a mold board and wherein a plurality of fasteners can inserted be through the elongated horizontal slotted punch apertures to engage the mounting holes of the plow blade and mold board, a cutout that is located between the two horizontal slotted punch apertures; two longitudinal carbide matrix grooves located along the bottom face of the plow guard body, wherein a carbide matrix is deposited by a weld wire into each carbide matrix groove, and wherein the plow guard is single piece cast steel.

In yet another embodiment a method of mounting a new plow guard on snowplows, grader blades, or other surface plows is provided. The exemplary method for replacing an existing worn plow blade and worn plow guard with a new plow blade and new guard includes providing a new plow blade, a plow guard comprising a serrated cutting surface comprising at least one protruding tooth comprised of a variety of peaks and channels, a cutout, at least one elongated horizontal slotted punch aperture that aligns with the mounting holes of a new plow blade and the mounting holes of the mold board, at least one longitudinal carbide matrix groove, wherein a carbide matrix is deposited into the carbide matrix groove, and an enlarged outer edge, wherein the plow guard is single piece cast steel; aligning at least one elongated horizontal slotted punch aperture with a series of mounting holes in the new plow blade and mold board; and attaching the new plow guard to the new plow blade and mold board through the aligned mounting holes with a plurality of mechanical fasteners.

DETAILED DESCRIPTION

Figure 1:
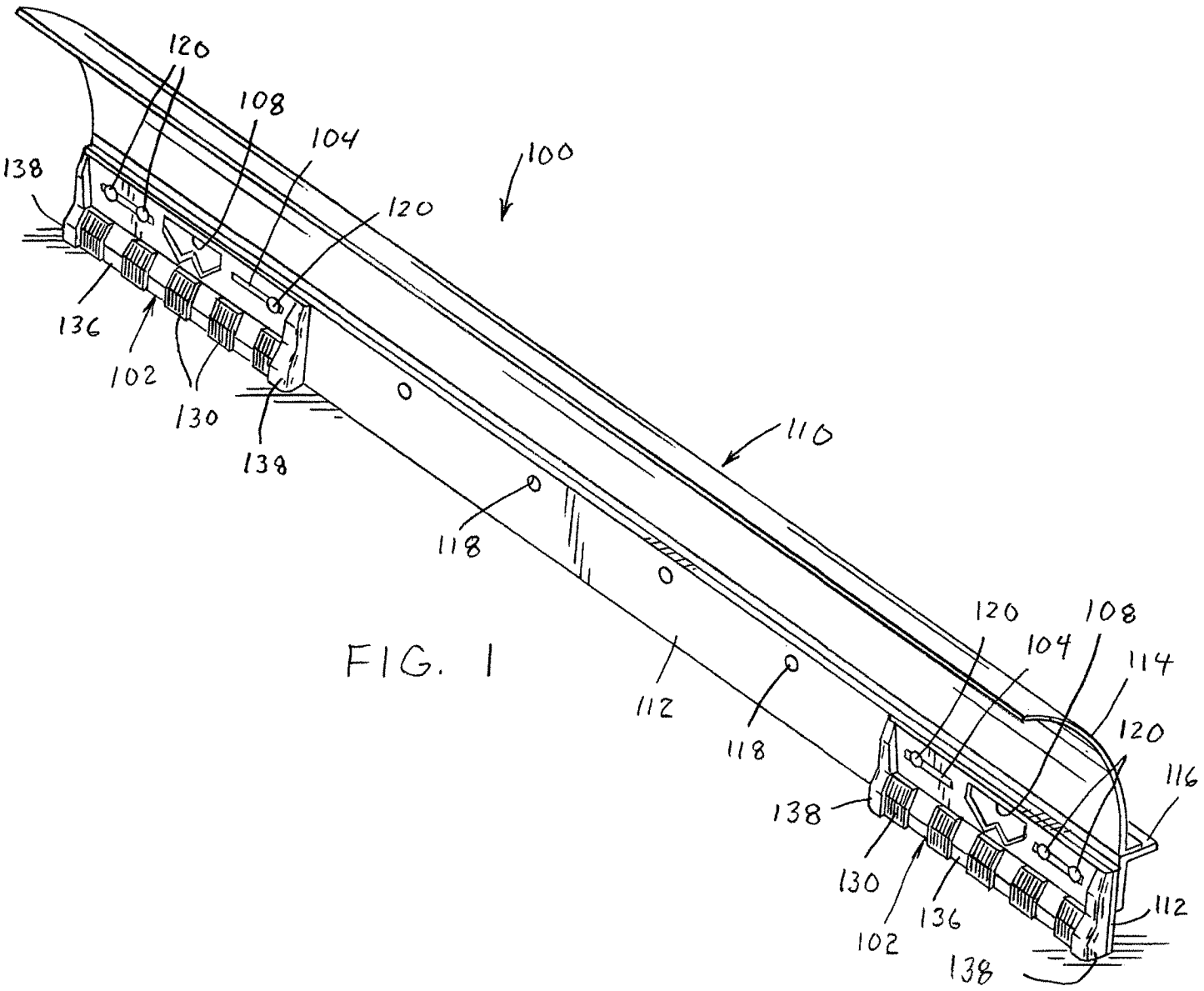
FIG. 1 is front perspective view of a plow guard system according to one aspect of the exemplary embodiment.

Turning to the drawings, FIG. 1 is a perspective view of an exemplary plow guard system 100. The plow guard system 100 includes at least one plow guard 102, which is affixed to a plow assembly 110. The plow assembly 110 is comprised of a plow blade 112, plow body 114, and a plow body edge or mold board 116. The plow body 114 is typically of hemispherical and funnel shaped steel construction for deflecting snow or other media. Further, the plow assembly 110 is comprised of a replaceable (or non-replaceable) plow body edge or mold board 116. The mold board 116 is typically of metallic construction, for example, steel construction, and is mounted to the plow body 114 by a plurality of mechanical fasteners, such as nuts, bolts, and washers (not shown).

The mold board 116 is usually replaceable, since its rigid construction is typically prone to damage due to abrasive contact with the surface being plowed or to obstacles, for example, curbs, potholes, sewer covers, trees, mailboxes, and the like, encountered while plowing. The mold board 116 typically includes slotted perforations to allow for adjustment of the mounting of the mold board 116 during initial installation or for adjustment of the mounting of the mold board 116 after use and wear. The plow blade 112 can be mounted to the mold board 116 through mechanical fastening means known in the art. The plow blade 112 includes mounting holes 118 aligned along the top edge of the plow blade 112 for securing to the mold board 116. The plow blade 112 can be from about ¼ inch thick to about 1¼ inch thick and can be made from steel or similar materials.

Still referring to FIG. 1, a plow guard system 100 is therein displayed. Typically, during use of plow blade 112 the blade edge and corners are worn and damaged while plowing. The plow guard 102 provides protection against premature and uneven wear of the plow blade by acting as a protective layer between the fragile plow blade 112 and the abrasive contact with the surface being plowed. The plow guard 102 body is generally comprised of a single piece cast steel alloy.

The steel casting can take on the following analysis (balance iron).

| C | Mn | P | S | Si | Cr | B | Hardness Bhn |
|---|---|---|---|---|---|---|---|
| X100<br>16 | X100<br>140 | X100<br>16 | X100<br>16 | X100<br>525 | X100<br>26 | X100<br>0.4 | 363/401 |

The greater the impact resistance, shear strength, and hardness of the sections, generally the better. Accord-ingly, armor steel castings can be used, typically ones with high chromium, carbon and silicon contents. Other armor steels, quenched and tempered ultraservice steels, and maraging steels also are useful here.

The plow guard 102 includes at least one horizontal slotted punch aperture 104 on the plow guard body. As shown in FIG. 1, the horizontal slotted punch aperture 104 is rectangular. The horizontal slotted punch aperture 104 is designed in an elongated manner to allow the plow guard 102 to fit most bolt hole patterns on commercial or concrete plows. The horizontal slotted punch aperture 104 can receive a plurality of fasteners 120 to fasten the plow guard 102 to the plow blade 112. In the exemplary embodiment of FIG. 1, the plow guard body is shown as having a horizontal slotted punch aperture 104 on each half of the plow guard body if divide along the midpoint of the length of the plow guard 102. In further embodiments it is to be appreciated that the horizontal slotted punch aperture may be of varying size and shape, such as rectangular, elliptical, triangular, etc. Further it is to be appreciated that in further embodiments a different aperture configuration could be used such that multiple apertures are stacked in series or parallel to fit an even wider array of bolt hole patterns.

Figure 2:
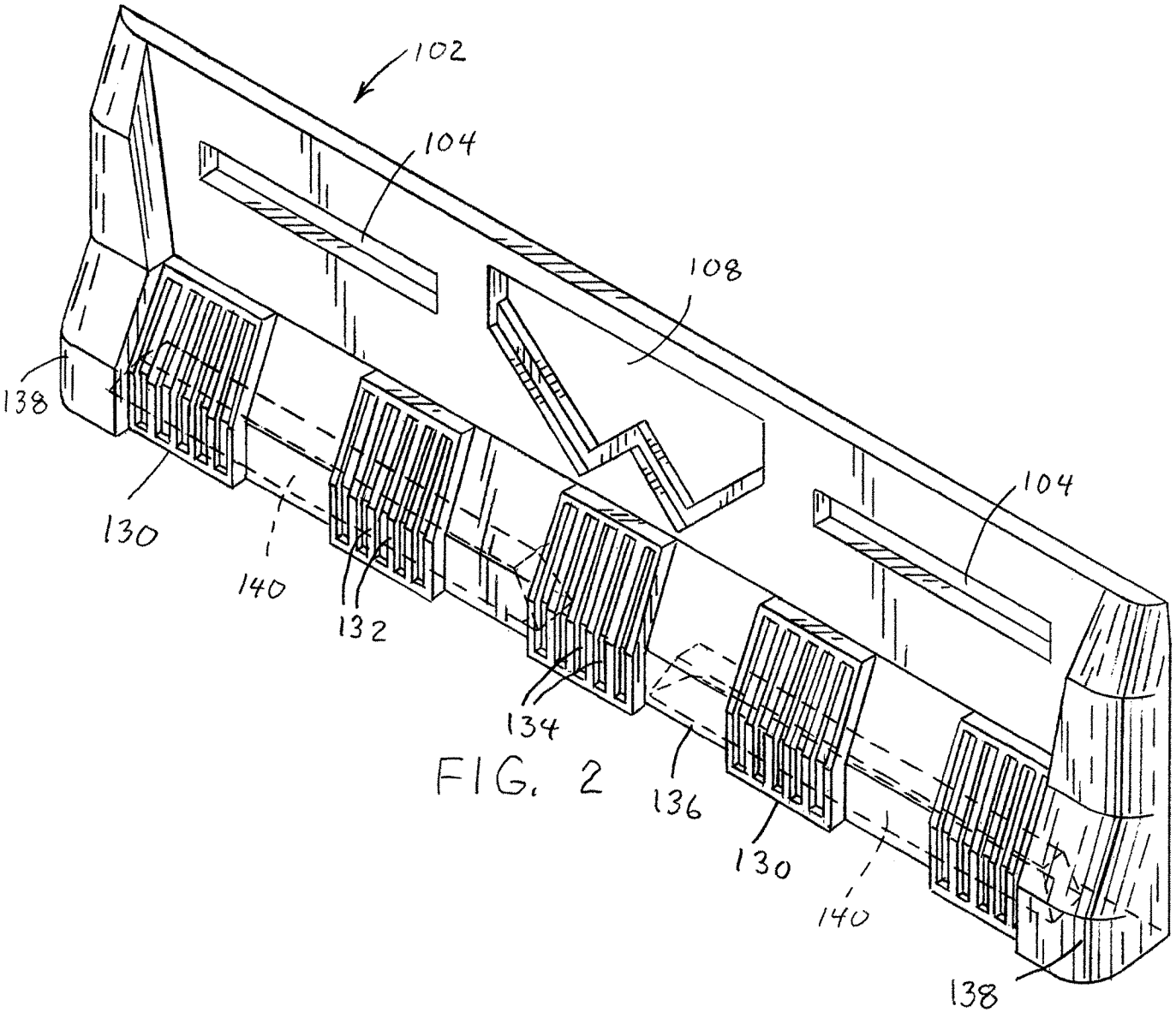
FIG. 2 is a front perspective view of a plow guard according to one aspect of the exemplary embodiment.
Figure 3:
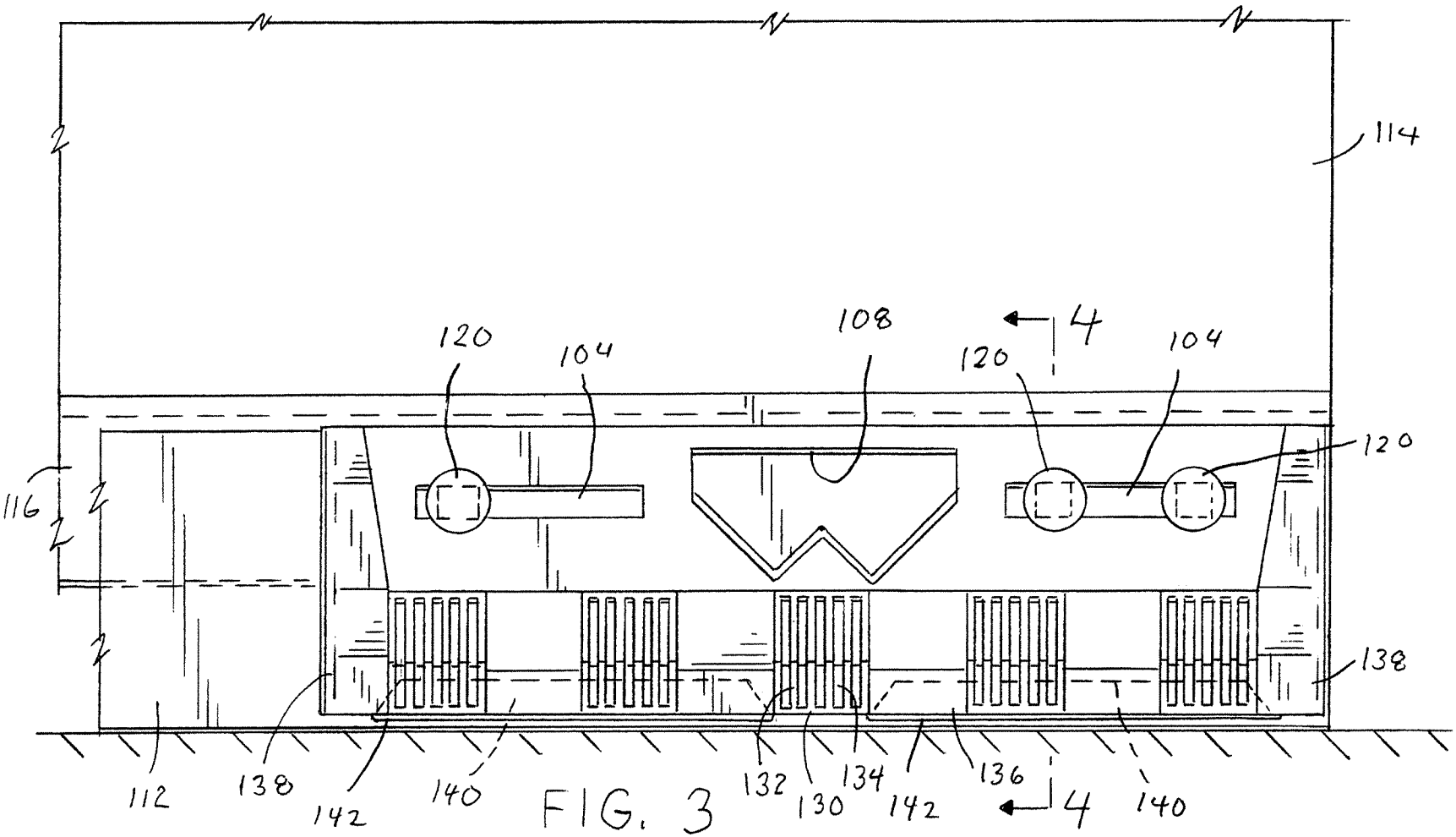
FIG. 3 is a front plan view of a plow guard system according to one aspect of the exemplary embodiment.

Another aspect of the exemplary embodiment, as shown in FIGS. 2 and 3, is that the plow guard 102 can include at least one protruding tooth 130 that acts as a serrated cutting surface. It should be appreciated that a plow guard can have any number of protruding teeth 130, limited only by the surface area of the plow guard. The protruding teeth 130 are raised normal to the plow guard wear surface 136 by at least a sixteenth of an inch. Each protruding tooth 130 is comprised of a plurality of peaks 132 and channels 134. The protruding teeth 130 act as channels to create an aggressive cutting surface to break up hard packed ice and snow and direct it vertically.

Additionally, the cutout 108 is an aperture in the one-piece steel alloy that makes up the plow guard 102. The cutout 108 reduces the overall weight and cost of materials of the plow guard 102. In the exemplary embodiment of FIGS. 2 and 3 the cutout 108 is centered between two horizontal slotted punch apertures 104. Also, optionally, the cutout 108 allows the plow guard 102 to be welded directly to the plow blade 112 to decrease lateral movement. It is to be appreciated that the cutout 108 can be any desired shape to meet any weight and/or cost reduction needs. In the exemplary embodiment the cutout 108 is depicted in a "W" formation (see, for example, FIG. 11), but it can also be in any common shape, such as a rectangle, circle, triangle, oval, etc. or a more complex shape, such as the "W" shown in the drawings to fit branding or marketing needs. Further still, the cutout can be used as a handle thus making install and handling of the plow guard 102 simpler.

Still referring to FIG. 2, the plow guard 102 body has at least one enlarged outer edge 138. The enlarged outer edge 138 extends beyond the face of the protruding teeth 130. The enlarged outer edge 138 acts as an increased barrier between the brittle corners of the plow blade 112 and the abrasive plow surface. As shown in FIG. 2, the plow guard 102 includes a pair of carbide matrix grooves 140 along the bottom face of the plow guard body.

Figure 4:
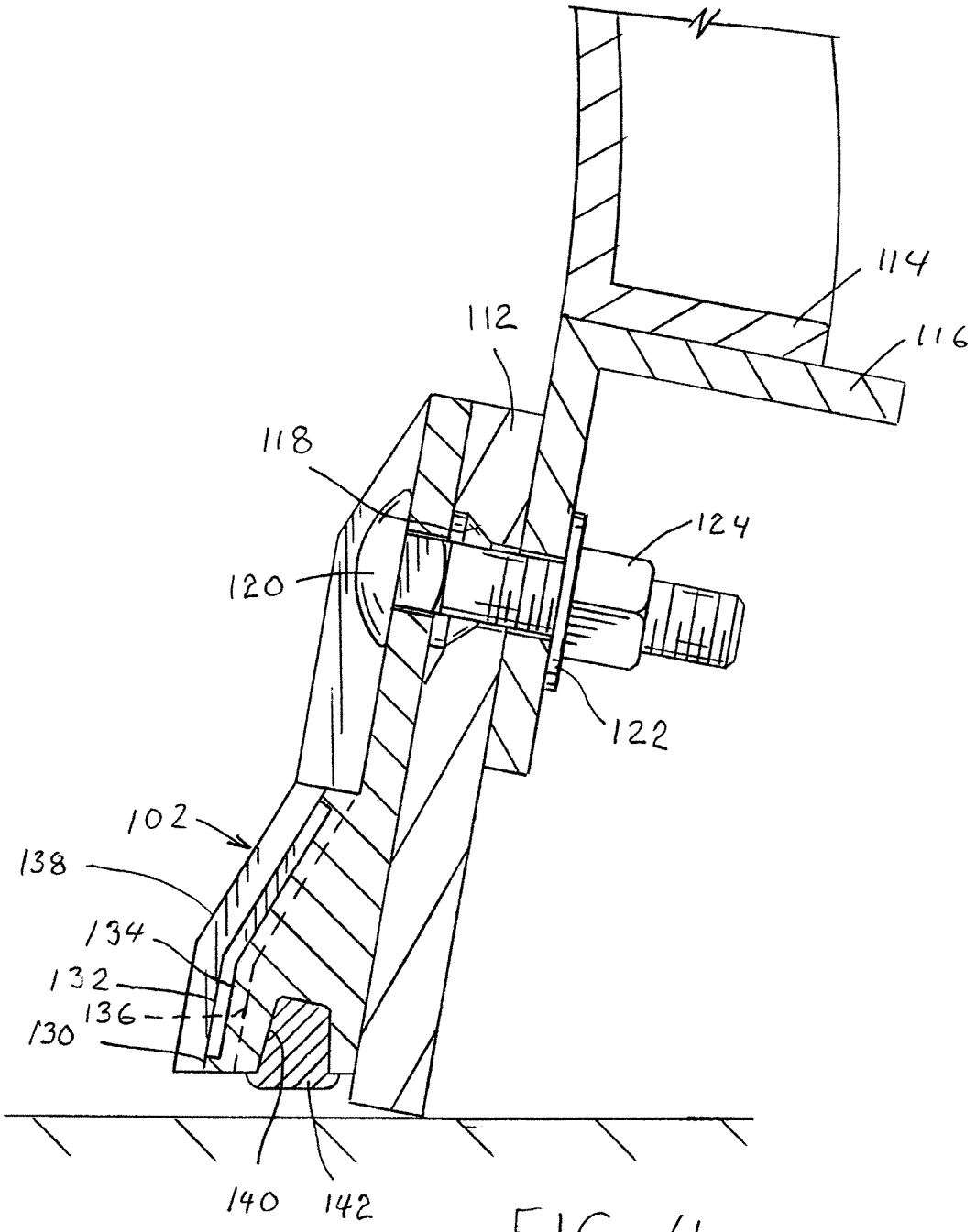
FIG. 4 is a cross section view taken along section lines 4-4 in FIG. 3 according to a first mounting arrangement of the plow guard system.

Referring now FIG. 4, which depicts a cross-section view of the plow guard system 100. Subsequent to casting, the carbide matrix groove 140 can be filled and/or overfilled by depositing therein a consumable carbide matrix 142. The carbide matrix 142 is deposited into the groove 140 by a carbide weld wire until it is filled or overfilled. Overfilling the groove 140 can result in a convex or bulbous layer of carbide matrix 142 terminating beyond, i.e., extending below, the plow guard wear surface 136. The matrix thus provides a reconstitutable embedded weldment or resistor for increased wear resistance of the plow guard wear surface 136. In one exemplary embodiment, two longitudinal carbide matrix grooves 140 extend in a series along substantially the length of the plow guard wear surface 136. Including the carbide matrix 142 throughout the plow guard 102 reinforces the most used surfaces of the plow guard 102, thus reducing in-season plow blade 112 changes, reducing downtime, saving money, and decreasing injuries.

Still referring to FIG. 4, the carbide matrix 142 deposited in the carbide matrix grove 140 can be transverse to the direction of travel. The plow guard wear surface 136 and deposited carbide matrix 142 help to support the cutting edges of the plow blade 112 and the mold board 116 such that the abrasive action and impact from the roadbed works on the plow guard wear surface 136 and the deposited carbide matrix 142 instead of the plow blade 112 cutting edges, thereby substantially prolonging the life of the cutting edge of the plow blade 112 and the mold board 116.

Also depicted in FIG. 4 is an exemplary mounting arrangement of the plow guard 102 to the plow assembly. As shown, the plow guard 102 is affixed via a means of mechanical fastening. For example, a plurality of nuts 124, washers 122, and bolts 120 can be provided to fasten the plow guard to the plow blade which is fastened to the mold board 116. The mold board 116 has a plurality of holes (not shown) that align with the bolt pattern mounting holes 118 of the plow blade 112. The horizontal slotted punch aperture 104 of the plow guard 102 aligns with the mounting holes of the plow blade 112 bolt pattern such that at least one fastener 120 can be fed through the horizontal slotted punch aperture 104 and into the mounting holes 118 of the plow blade 112 bolt hole pattern and corresponding mold board 116 hole. It is to be appreciated that any number of mechanical fasteners 120 can be used to affix the plow guard 102 to the plow blade 112. The horizontal slotted punch aperture 104 is dimensioned to have a wide aperture to enable a user to use the same plow guard 102 on a variety of plow of different plows with differing bolt hole patterns. In the exemplary embodiment the horizontal slotted punch aperture 104 of the plow guard 102 fits plows made from various manufacturers.

Figure 5:
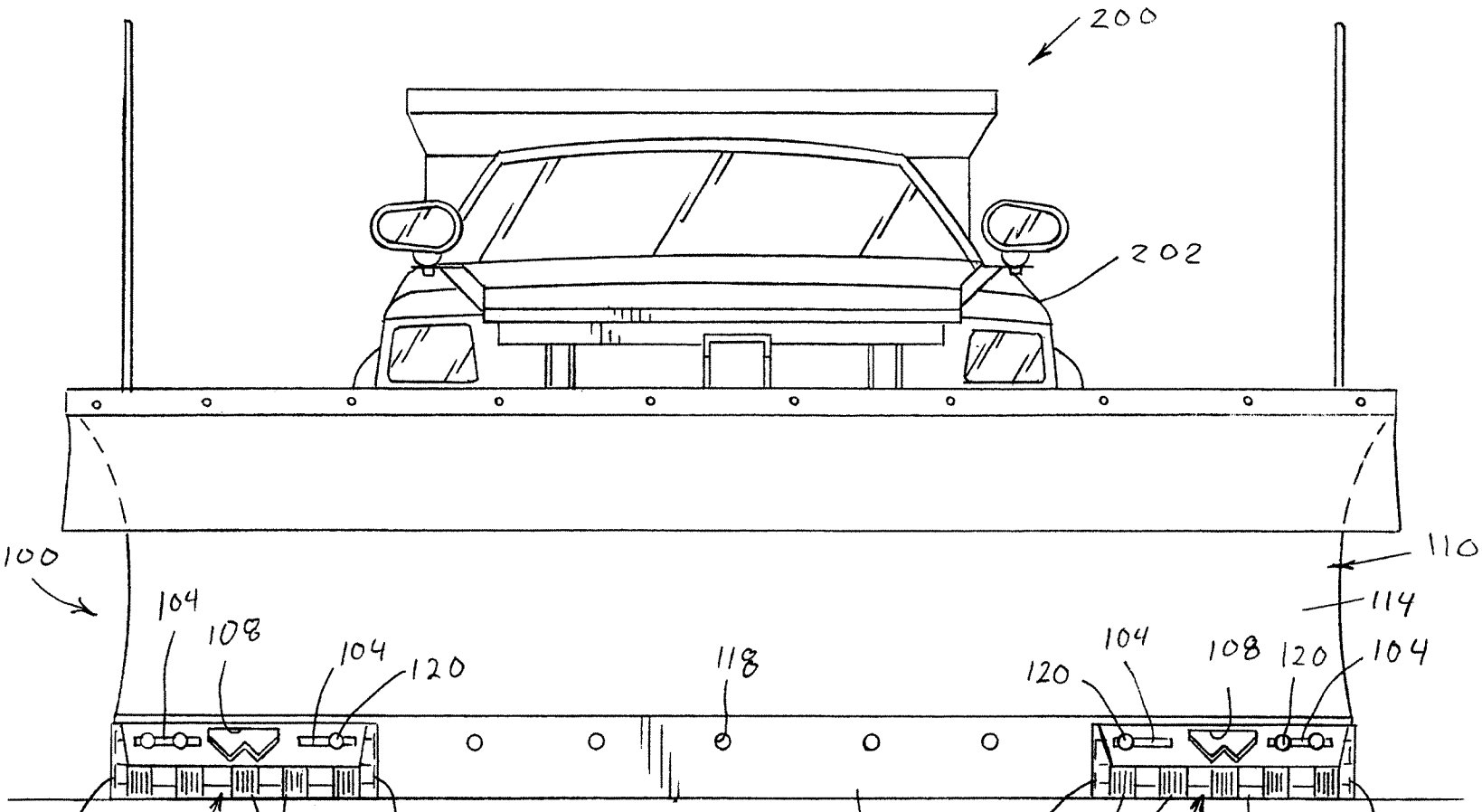
FIG. 5 is a front plan view of a plow guard system mounted to a vehicle according to one aspect of the exemplary embodiment.

FIG. 5 depicts a vehicle attachment configuration 200 that is comprised of the plow guard assembly 100, which includes the plow assembly 110 and the plow guard 102, and is attached to a vehicle 202 by means of an appropriate frame or housing (not shown). The vehicle 202 may be any vehicle ranging from a standard car or pickup truck to a sand and salt-carrying dump truck to a road grader.

Figure 7:
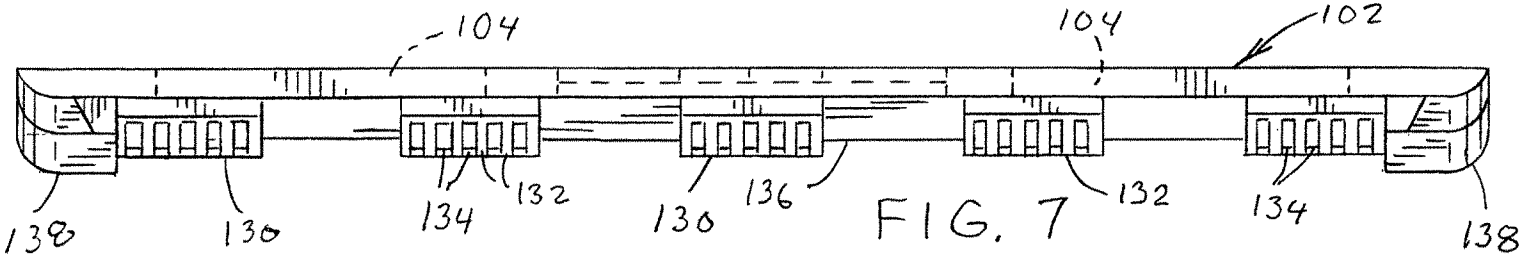
FIG. 7 is a top plan view of the plow guard of FIG. 6.
Figure 6:
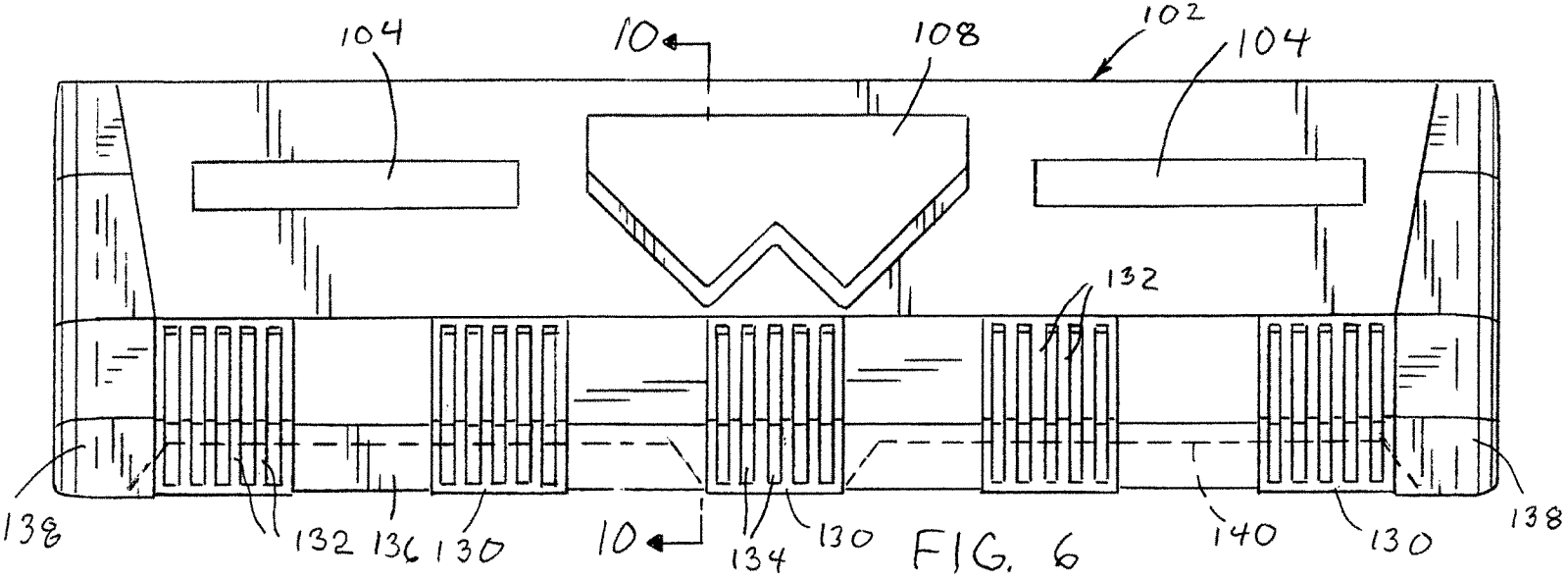
FIG. 6 is a front plan view of a plow guard according to one aspect of the exemplary embodiment.
Figure 8:
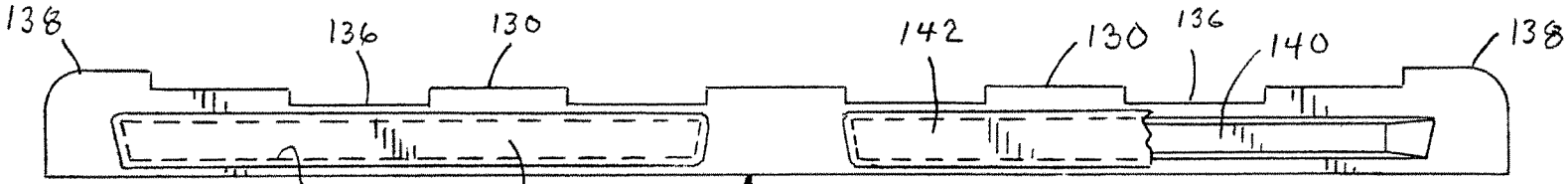
FIG. 8 is a bottom plan view of the plow guard of FIG. 6.

Referring now to FIGS. 6-8, the plow guard 102 is depicted as having five sets of protruding teeth 130. It is to be appreciated that the plow guard 102 can have any number of protruding teeth 130 to fit the operator's needs. The peaks 132 and channels 134 are depicted as having consistent depth and width across the length of the plow guard 102, however, it is to be appreciated that in other embodiments the peaks 132 and channels 134 can have varying depths and widths across the plow guard 102 to meet the needs of the operator. Additionally, it is shown that the embodiment depicted in FIG. 8 shows two longitudinal carbide matrix grooves 140 along the length of the plow guard 102 filled overfilled with a bulbous layer of carbide matrix 142. However, in further embodiments it is to be appreciated that there can be more or fewer longitudinal carbide matrix grooves 140 depending on the needs of the operator.

Figure 10:
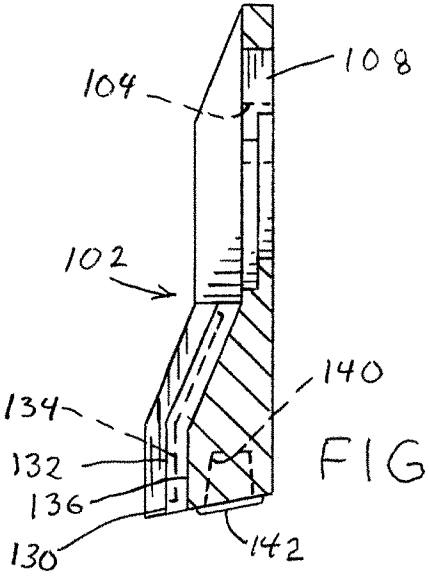
FIG. 10 is a cross section view taken along section lines 10-10 in FIG. 6.
Figure 9:
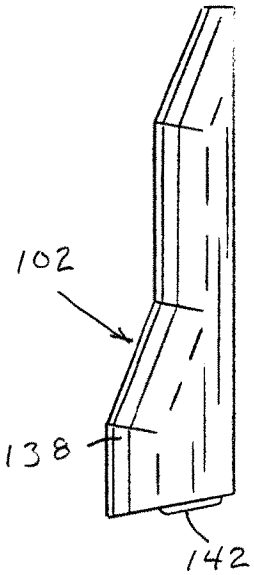
FIG. 9 is a side plan view of the plow guard of FIG. 6.
Figure 11:
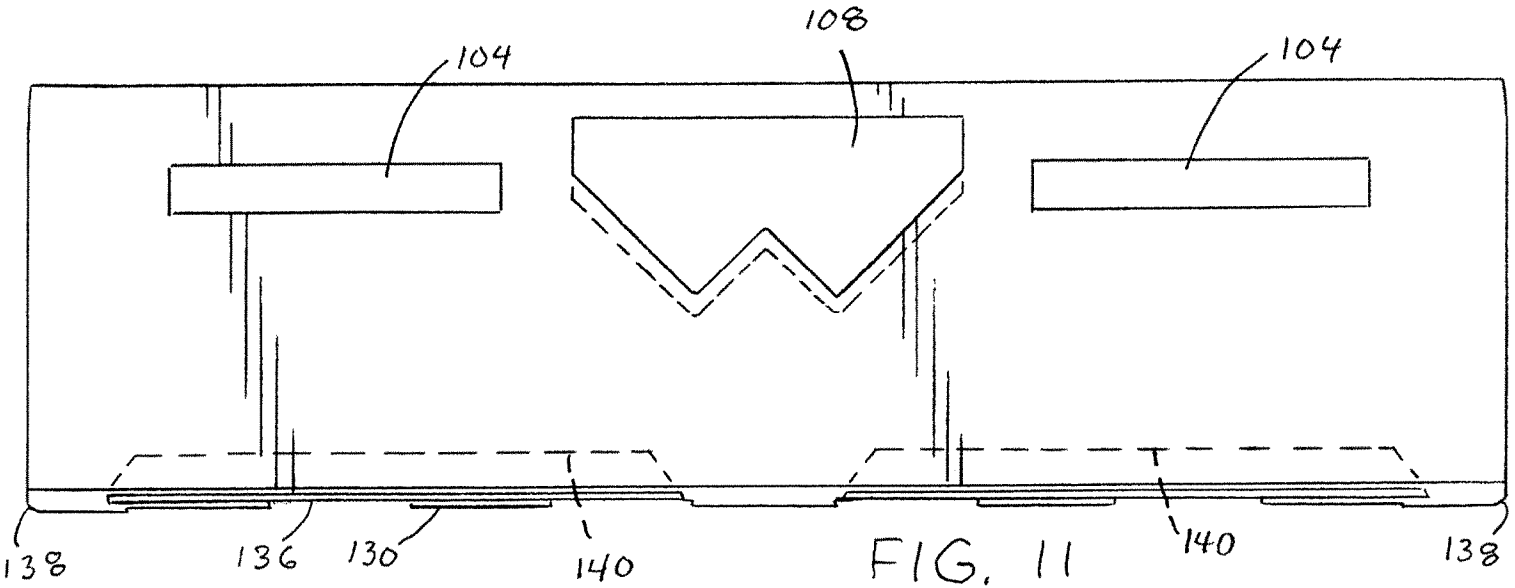
FIG. 11 is a rear plan view of the plow guard of FIG. 6.

As shown in FIGS. 9-11, the longitudinal carbide matrix grooves generally have a width less than width of the plow guard 102. It is to be appreciated that, in use, the plow guard 102 and the layer of layer of carbide matrix 142 will wear to the point that a bottom and/or corner edge of plow blade 112, depending on whether the plow guard 102 is placed on the edge or in the middle of plow blade 112, will be proximal to the edge of the plow guard 102. In this manner, the plow blade 112 will generally be proximal to, or in contact with, the road or underlying surface. An operator will need to replace the plow guard 102 when it is worn to be proximal to the edge of the plow blade 112.

It is to be understood that the method of mounting the plow guard 102 can be used to provide a mold board 116 with a new plow blade 112 and new plow guard 102 or replace a worn plow guard. As discussed above the horizontal slotted punch aperture is much wider than a bolt hole found on a plow blade or mold board. This is done to enable the installer of the plow guard 102 to fit the plow guard 102 to most bolt hole patterns on commercial or concrete plows. As a preliminary step, an installer will replace a worn plow guard 102 and worn plow blade 112 from the mold board 116 if necessary. If it is not necessary, then the first step will be for an installer to select the appropriate size plow guard 102 and plow blade 112 needed for the mold board 116 on their vehicle 202. Next, the installer will position the plow blade 112 such that the bolt pattern aligns with the mounting holes of the mold board 116. Following positioning of the plow blade 112, the horizontal slotted punch aperture 104 of the plow guard 102 must be aligned with the mounting holes 118 of the plow blade bolt pattern. At least one mounting hole 118 must align with the horizontal slotted punch aperture 104. Once positioned, a fastener, such as the bolt 120, is fed through the horizontal slotted punch aperture 104, the plow blade mounting hole 118, and the mold board mounting hole. After the bolt 120 is fed through it is secured in place by a washer 122 and a nut 124. This step of securing the plow guard 102 to the plow blade 112 until all the open mounting holes 118 that align with the horizontal slotted punch aperture 104 are secured with fasteners 120. These steps are repeated depending on how many plow guards 102 are desired for the plow blade 112.

In the exemplary embodiment shown in the figures, the plow guard 102 is most typically used on city roads and parking lots of concrete, chip-seal, and asphalt at high or low speeds with a front straight plow and a preferred angle of attack of 65°.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A plow guard for mounting to a snowplow, the plow guard comprising:

a plow guard body;

a plow guard wear surface along the plow guard body;

at least one enlarged outer edge on the plow guard body;

a plurality of protruding teeth protruding from the plow guard wear surface, wherein each protruding tooth comprises a plurality of peaks and channels to form a serrated cutting surface on the plow guard wear surface;

an elongated horizontal slotted punch aperture along the plow guard body; and at least one longitudinal carbide matrix groove, wherein said plow guard is a single piece steel casting, and wherein said single piece of steel casting is an armor steel casting selected from the group consisting of a tempered steel and a maraging steel.

2. The plow guard of claim 1, wherein said serrated cutting surface is raised normal to the plow guard wear surface by at least a sixteenth of an inch.

3. The plow guard of claim 1, wherein each protruding tooth of the plurality of protruding teeth is separated from one another along the plow guard wear surface.

4. The plow guard of claim 1, wherein said elongated horizontal slotted punch aperture aligns with a plurality of mounting holes of a plow blade and mounting holes of a mold board.

5. The plow guard of claim 4, wherein a plurality of fasteners can be inserted through the elongated horizontal slotted punch aperture to engage the mounting holes of the plow blade and the mounting holes of the mold board.

6. The plow guard of claim 1, wherein said longitudinal carbide matrix groove is located along a bottom face of the plow guard body.

7. The plow guard of claim 1, wherein a carbide matrix is deposited into said longitudinal carbide matrix groove.

8. The plow guard of claim 7, wherein said carbide matrix is deposited into said longitudinal carbide matrix groove by a weld wire.

9. A plow guard for mounting to a snowplow, the plow guard comprising:

a plow guard body;

a plow guard wear surface along the plow guard body;

an enlarged outer edge on the plow guard body;

a plurality of protruding teeth protruding normal to the plow guard wear surface, wherein each protruding tooth of the plurality of protruding teeth is separated from one another along the plow guard wear surface, and wherein each protruding tooth of the plurality of protruding teeth comprises a plurality of peaks and channels to define a serrated cutting surface on the plow guard wear surface;

two elongated horizontal slotted punch apertures along the plow guard body, wherein the elongated horizontal slotted punch apertures are not connected to one another and are on different halves of the plow guard body, wherein the elongated horizontal slotted punch apertures are configured to align with a plurality of mounting holes of a plow blade and a mold board, and wherein the elongated horizontal slotted punch apertures are configured to receive a plurality of fasteners to engage with the mounting holes of the plow blade and mold board;

a cutout that is located between the two elongated horizontal slotted punch apertures; and two longitudinal carbide matrix grooves located along a bottom face of the plow guard body, wherein a carbide matrix is deposited by a weld wire into each carbide matrix groove, and wherein the plow guard is a single piece steel casting.

10. A method for replacing an existing worn plow guard and worn plow blade with a new plow guard and new plow blade, the method comprising:

providing a plow guard comprising:

at least one serrated cutting surface comprising a first protruding tooth and a second protruding tooth separated from the first protruding tooth along the plow guard, wherein each protruding tooth comprises a variety of peaks and channels;

at least one cutout;

at least one elongated horizontal slotted punch aperture that aligns with a series of mounting holes of a plow blade and mold board;

at least one longitudinal carbide matrix groove, wherein a carbide matrix is deposited into the at least one longitudinal carbide matrix groove; and an enlarged outer edge, wherein the plow guard is single piece steel casting;

aligning the at least one elongated horizontal slotted punch aperture with the series of mounting holes in the plow blade and mold board; and attaching the plow guard to the plow blade and mold board through the aligned mounting holes with a plurality of mechanical fasteners.

* * * * *